US007142802B2

(12) United States Patent
Lee et al.

(10) Patent No.: US 7,142,802 B2
(45) Date of Patent: Nov. 28, 2006

(54) FIXING UNIT USED WITH AN IMAGE FORMING APPARATUS AND AN IMAGE FORMING APPARATUS HAVING THE SAME

(75) Inventors: Jin-soo Lee, Suwon-si (KR); Heung-sup Jeong, Suwon-si (KR); Kyung-shig Chung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 90 days.

(21) Appl. No.: 10/958,398

(22) Filed: Oct. 6, 2004

(65) Prior Publication Data

US 2005/0089352 A1 Apr. 28, 2005

(30) Foreign Application Priority Data

Oct. 27, 2003 (KR) ..... 10-2003-0075238

(51) Int. Cl.
*G03G 15/20* (2006.01)

(52) U.S. Cl. ..... 399/322; 399/323

(58) Field of Classification Search ..... 399/122, 399/322, 323, 398, 399, 401, 405, 406
See application file for complete search history.

(56) References Cited

FOREIGN PATENT DOCUMENTS

KR 10-0362386 11/2002

KR 100362386 * 11/2002

OTHER PUBLICATIONS

Korean Official Action issued on Sep. 1, 2005, for Korean Patent Application No.: 10-2003-0075238.

* cited by examiner

*Primary Examiner*—Hoang Ngo
(74) *Attorney, Agent, or Firm*—Stanzione & Kim, LLP

(57) ABSTRACT

A fixing unit and an image forming apparatus using the same. The fixing unit includes: a pair of fixing rollers that rotate and face each other and apply heat and pressure to a toner image transferred to the sheet of paper using electrophotography; a plurality of guide members disposed in the width direction of the sheet of paper to guide the sheet of paper discharged from the pair of fixing rollers to the discharge path, each of the guide members including a first guiding portion extending toward the discharge path from an outlet of the pair of fixing rollers; a first arm rotatably installed between the guide membersthat elastically contact the sheet of paper drawn out of the pair of fixing rollers and guide the sheet of paper to the discharge path; and an elastic member elastically biasing the first arm such that the first arm contacts the sheet of paper, wherein a guide member adjacent to the first arm has a second guide portion that is shorter than the first guide portion.

30 Claims, 8 Drawing Sheets

FIXING UNIT USED WITH AN IMAGE FORMING APPARATUS AND AN IMAGE FORMING APPARATUS HAVING THE SAME

CROSS-REFERENCE TO RELATED APPLICATIONS

This application claims the priority of Korean Patent Application No. 2003-75238, filed on Oct. 27, 2003, in the Korean Intellectual Property Office, the disclosure of which is incorporated herein in its entirety by reference.

BACKGROUND OF THE INVENTION

1. Field of the Invention

The present general inventive concept relates to a fixing unit used with an image forming apparatus and an image forming apparatus having the same and using an electrophotographic method to point an image on a sheet of paper.

2. Description of the Related Art

An electrophotographic image forming apparatus is a device that prints a single or multiple color image on a sheet of paper (or other image recording media) by forming an electrostatic latent image by radiating light onto a photosensitive medium charged to a predetermined potential, developing the latent image into a toner image using toner of a predetermined color, and transferring and fixing the toner image to the sheet of paper. The printed sheet of paper is discharged along a discharge path.

FIG. 1 is a sectional view of a discharge path of a conventional image forming apparatus, and FIG. 2 is a plan view of FIG. 1.

Referring to FIG. 1, there are shown a heat roller 71 and a pressure roller 72 for applying heat and pressure on a toner image attached onto a sheet of paper S by electrostatic attraction in order to fix the toner image on the sheet of paper S. Reference numeral 40 is a guide member for leading the printed sheet of paper S to the discharge path 20. Reference numeral 50 is a discharge roller for releasing the sheet of paper S. The guide member 40 is fixed at an outlet of the heat roller 71 and the pressure roller 72. As shown in FIG. 2, a plurality of guide members 40 are installed in a width direction of the sheet of paper S. The sheet of paper S passing between the heat roller 71 and the pressure roller 72 contacts a first plane 41. Since the guide members 40 are fixed, the sheet of paper S becomes bent along the first plane 41 and is led to the discharge path 20. Due to this structure, the first plane 41 repeatedly contacts the sheet of paper S so that paper dust or toner residues are separated from the paper S and adhere to the paper S.

The procedure by which toner adheres to the first plane 41 will be described below. The sheet of paper S can be a new sheet or a used sheet of paper of which an image has been already printed on a surface. If the used sheet of paper is heated or pressed between the heat roller 71 and the pressure roller 72, the toner image formed on the surface of the paper is melted and softened. In this state, when the sheet of paper S reaches the first plane 41, its back rubs against the first plane 41 so that the toner adheres to the first plane 41. Such a phenomenon where toner adheres to the first plane 41 becomes severe in duplex printing. This is because the sheet of paper S where an image is printed on one side enters a printer unit (not shown) through a returning path 30, and then a toner image is transferred thereto and heated once more by the heat roller 71 and the pressure roller 72 before the heat previously supplied by the heat roller 71 and the pressure roller 72 is cooled.

When more toner or paper dust adheres to the first plane 41, it is more likely that paper becomes jammed. For example, a front end of the sheet of paper S cannot smoothly pass through the paper path when toner is irregularly attached to the first plane 41. As shown in FIG. 1, the guide members 40 are installed near the heat roller 71 and the pressure roller 72 so that they have a temperature higher than other portions of the image forming apparatus due to the heat of the heat roller 71 and the pressure roller 72. Toner, which is usually in the form of a resin of a predetermined color, becomes sticky when not completely cooled. Therefore, a paper jam may occur because the friction between the sheet of paper S and the first plane 41 to which the toner has adhered increases.

Such a paper jam may occur in the discharge path 20. The toner adhering to the first plane 41 becomes soft by the heat of the fixer 70 and is transferred to the front end of the sheet of paper S when there is a friction between the front end of the sheet of paper S and the first plane 41. The traveling path of the front end of the sheet of paper S is changed as the front end of the sheet of paper S contacts an upper portion B of the discharge path 20 in order to change its course. At this time, toner may adhere to the upper portion B of the discharge path 20. If more toner adheres to the upper portion B of the discharge path 20, the front end of the sheet of paper S is caught in the upper portion B of the discharge path 20, thereby causing a paper jam.

SUMMARY OF THE INVENTION

The present general inventive concept provides a fusing unit and an image forming apparatus having the same wherein the friction between a sheet of paper and a guide member is reduced to prevent toner from being separated from the sheet of paper and adhering to a path of the sheet of paper.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a fixing unit used with an image forming apparatus, the fixing unit including: a pair of fixing rollers to rotate and face each other and to apply heat and pressure to a toner image transferred to the sheet of paper; a plurality of guide members disposed in the width direction of the sheet of paperto guide the sheet of paper discharged from the pair of fixing rollers to the discharge path, each of the guide members including a first guiding portion extending to the discharge path from an outlet of the pair of fixing rollers; a first arm rotatably installed between the guide members to elastically contact the sheet of paper drawn out of the pair of fixing rollers, and to guide the sheet of paper to the discharge path; and an elastic member to elastically bias the first arm to contact the sheet of paper, wherein a guide member adjacent to the first arm has a second guide portion that is shorter than the first guide portion.

The foregoing and/or other aspects and advantages of the present general inventive concept are achieved by providing an image forming apparatus including: a printing unit to transfer a toner image to a sheet of paper; a pair of fixing rollers to rotate and face each other and to apply heat and pressure to the toner image; a discharge path to discharge the sheet of paper to which the toner image has been fixed; a plurality of guide members disposed in the width direction of the sheet of paper and to guide the sheet of paper discharged from the pair of fixing rollers to the discharge path, each of the guiding members having a first guiding portion extending to the discharge path from an outlet of the pair of fixing rollers; a first arm rotatably installed between the guide members and to elastically contact the sheet of paper drawn out of the pair of fixing rollers, and to guide the sheet of paper to the discharge path; and an elastic member elastically biasing the first arm such that the first arm contacts the sheet of paper, wherein one of the guide members adjacent to the first arm has a second guide portion that is shorter than the first guide portion.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
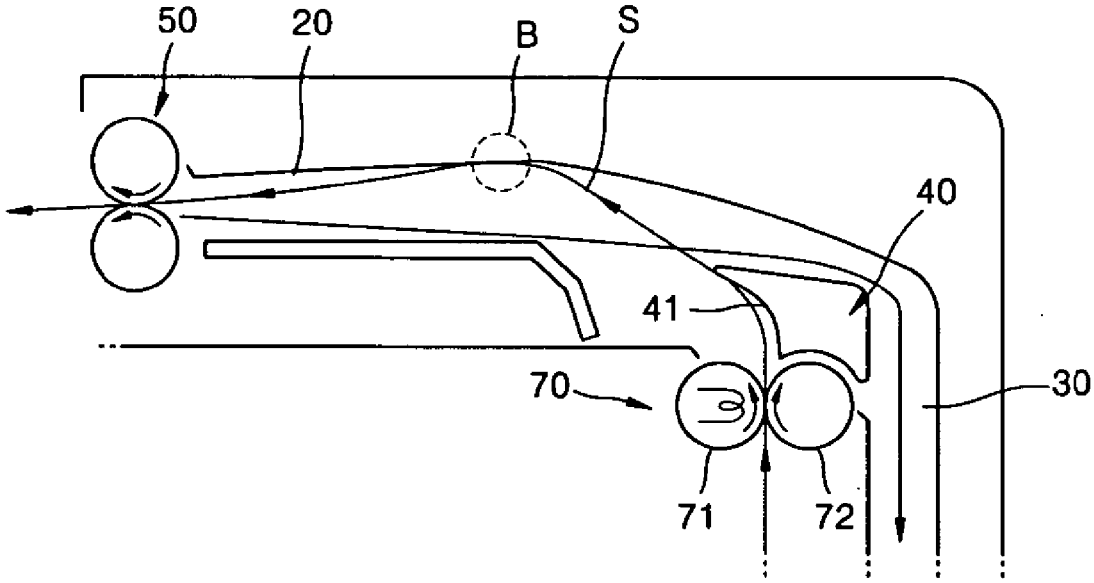
FIG. 1 (PRIOR ART)
FIG. 1 is a sectional view illustrating a discharge path of a conventional image forming apparatus.
Figure 2:
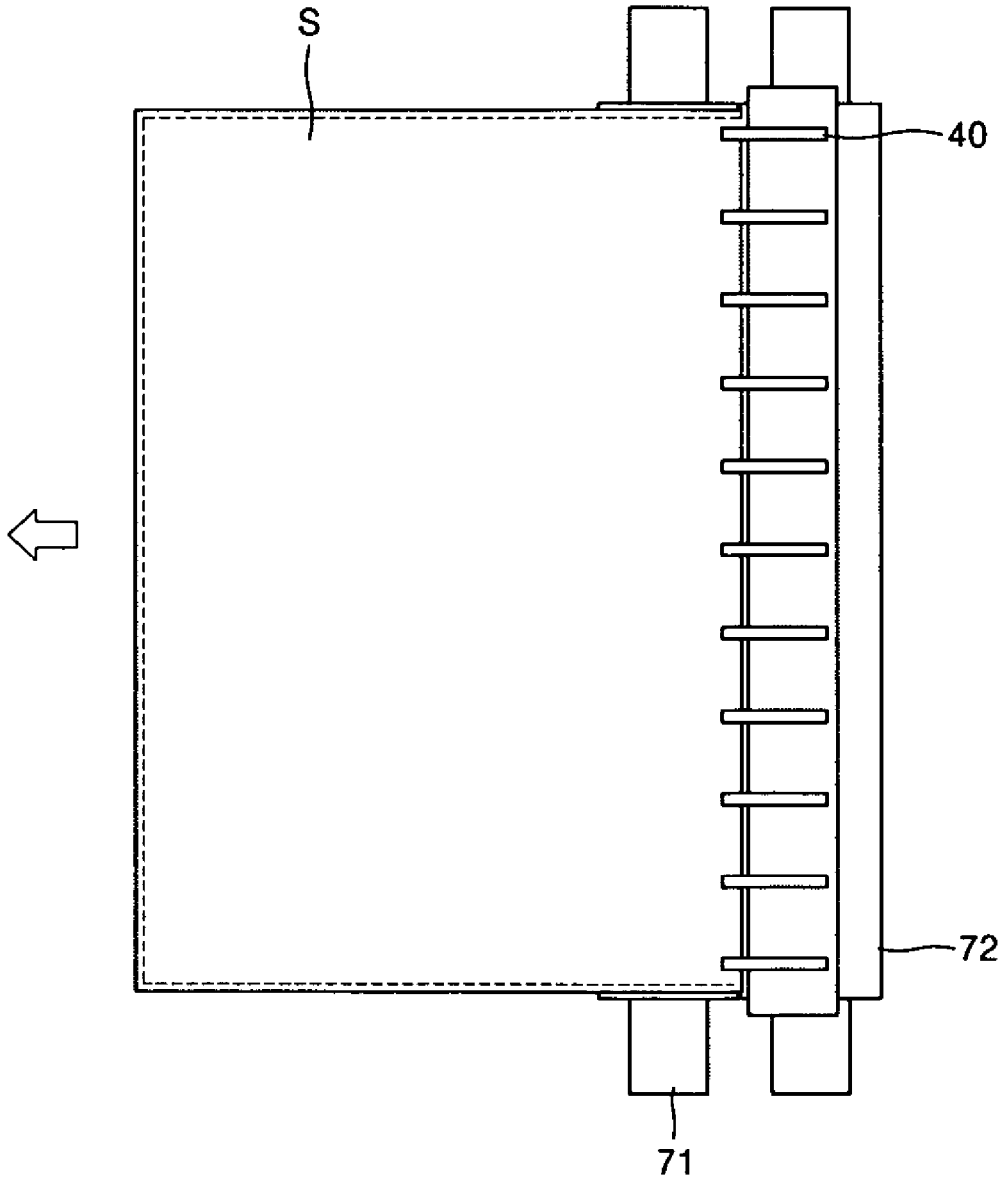
FIG. 2 (PRIOR ART)
FIG. 2 is a plan view of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
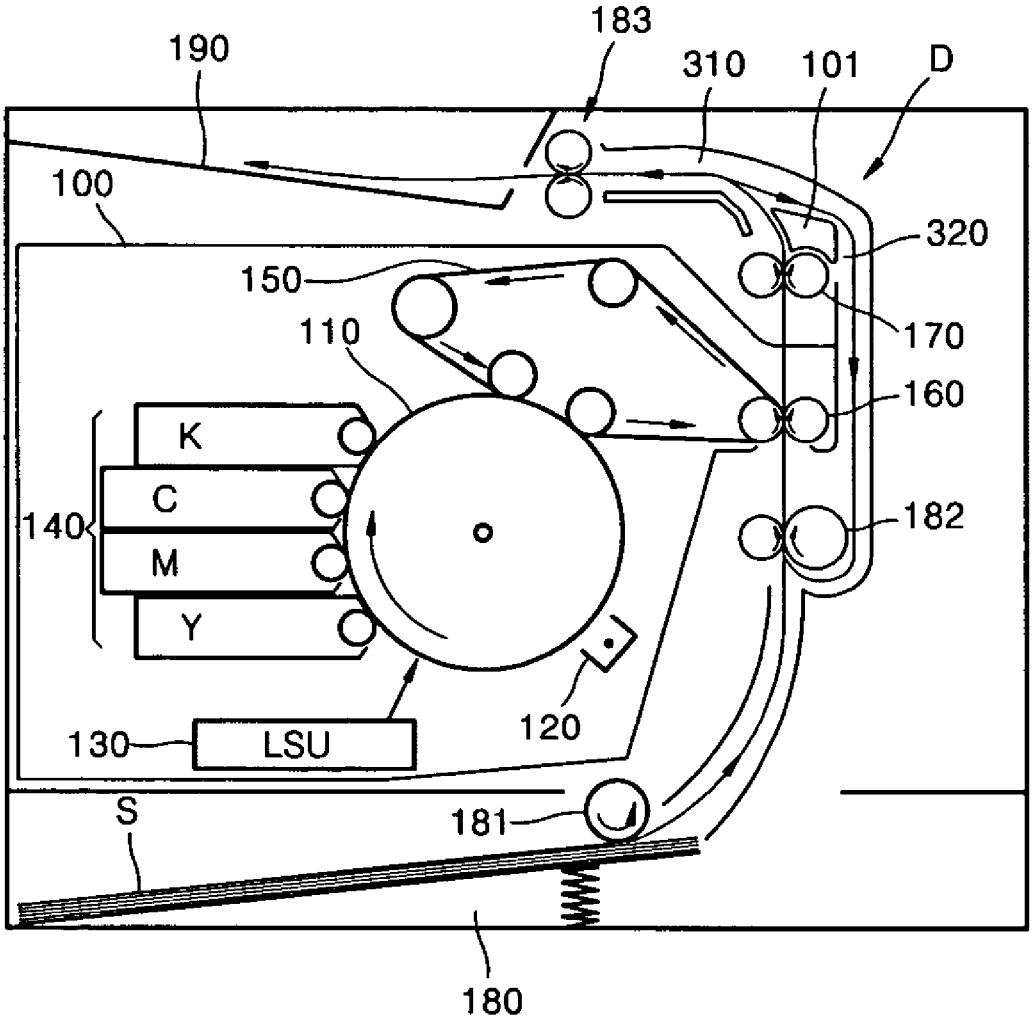
FIG. 3 is a schematic view illustrating a configuration of an image forming apparatus according an embodiment of the present general inventive concept.
Figure 4:
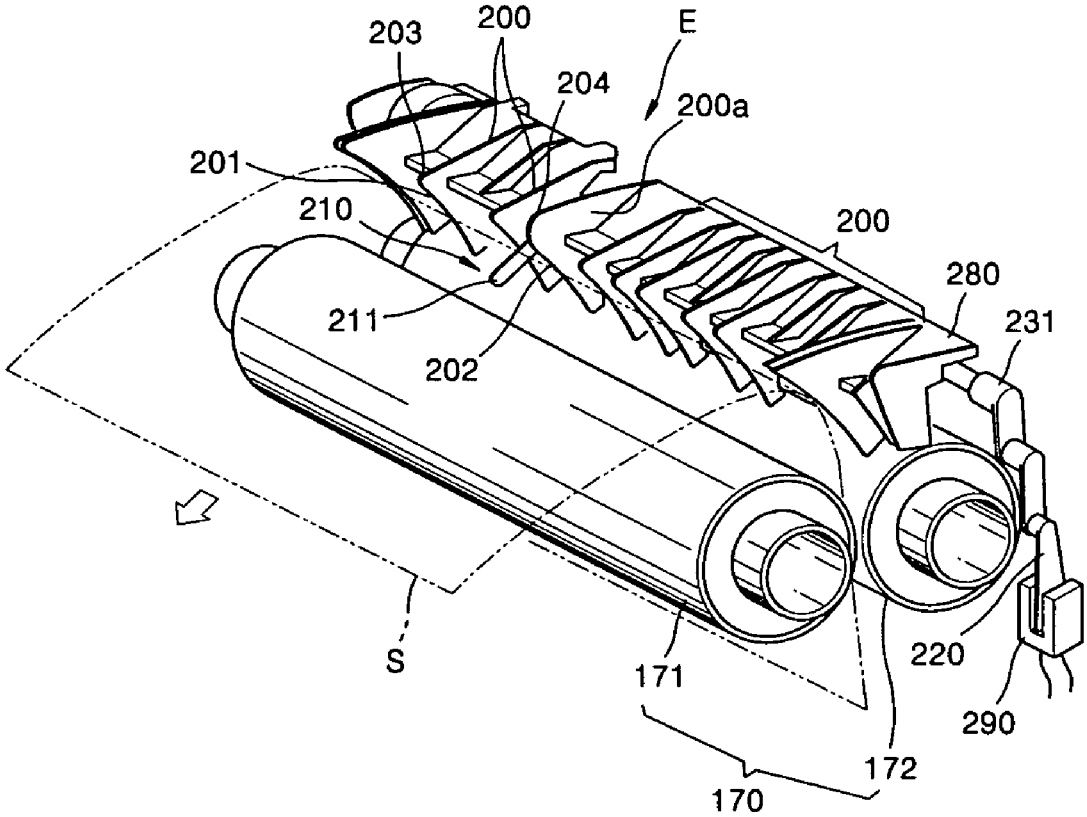
FIG. 4 is a detailed perspective view of a portion D in FIG. 3.

Referring to FIGS. 3 and 4, an image forming apparatus according to an embodiment of the present invention includes a printing unit 100 that transfers a toner image to a sheet of paper S using eletrophotography, first and second fixing rollers 171 and 172 of a fixing member 170, a discharge path 310, and a returning path 320. Reference numerals 180, 181, and 182 indicate a paper cassette, a pickup roller, and a feed roller, respectively.

The printing unit 100 includes a charging member 120, a laser scanning unit (LSU) 130, a photoreceptor drum 110, a developer unit 140 containing a developing agent, a transfer belt 150, and a transfer roller 160. The printing unit 100 prints an image on the sheet of paper S using electrophotography. The printing unit 100 according to the present general inventive concept can print color images since it has four developers 140K, 140C, 140M and 140Y within the developing unit 140 respectively containing toners of black K, cyan C, magenta M, and yellow Y colors.

The procedure of forming images by the printing unit 100 is as follows. First, the charging member 120 supplies electric charges to the photoreceptor drum 110 so that the surface thereof has uniform potential. According to an exposure process, when the LSU 130 projects light corresponding to image information of, for example, yellow color, onto the photoreceptor drum 110, an electrostatic latent image of yellow color is formed due to the difference of potential between an irradiated portion and an non-irradiated portion of the photoreceptor drum 110. The developer 140Y supplies a yellow toner to the electrostatic latent image to form a yellow toner image, and the yellow toner image is transferred to the transfer belt 150.

After the yellow toner image is completely transferred to the transfer belt 150, toner images of magenta M, cyan C and black K colors are transferred sequentially to the transfer belt 150, thereby resulting in a full color image on the transfer belt 150. The sheet of paper S is drawn out of the paper cassette 180 by the pickup roller 181 and carried by the feed roller 182. The sheet of paper S arrives at a location where the transfer belt 150 faces the transfer roller 160, conforming to the point when the front end of the color toner image reaches the same point, so that the color toner image is transferred to the sheet of paper S.

The sheet of paper S to which the color toner image has been transferred moves between the first and second fixing rollers 171 and 172. The first and second fixing rollers 171 and 172 are rotated while being pushed to be closer each other. At least one of the first and second fixing rollers 171 and 172 includes a heating element. In this embodiment of the present general inventive concept, both the first and second fixing rollers 171 and 172 have a heating element. Hereinafter, the first and second fixing rollers 171 and 172 will be collectively called the fixing member 170. The fixing member 170 fixes the color toner image to the sheet of paper S by applying heat and pressure thereto.

Although the above embodiment is described with reference to a multi-pass mode printing unit using a single photoreceptor drum and a LSU, the present general inventive concept is not limited there to, and can be used in the form of various electrophotographic printing units.

The discharge path 310 connects the fixing member 170 and the discharge roller 183, forming a path along which the printed sheet of paper S is discharged into a discharge tray 190. The image forming apparatus according to this embodiment may further have a returning path 320 used with double-sided printing. The returning path 320 turns over the sheet of paper S where an image has been printed on one side and supplies it to the printing unit 100 in order to allow printing onto the back of the sheet S. The returning path 320 is branched off from the discharge path 310 and extends to the feed roller 182 that feeds the sheet of paper S to the printing unit 100. An additional driving unit (not shown) for paper feeding may be provided along the discharge path 310 and the returning path 320.

Figure 5:
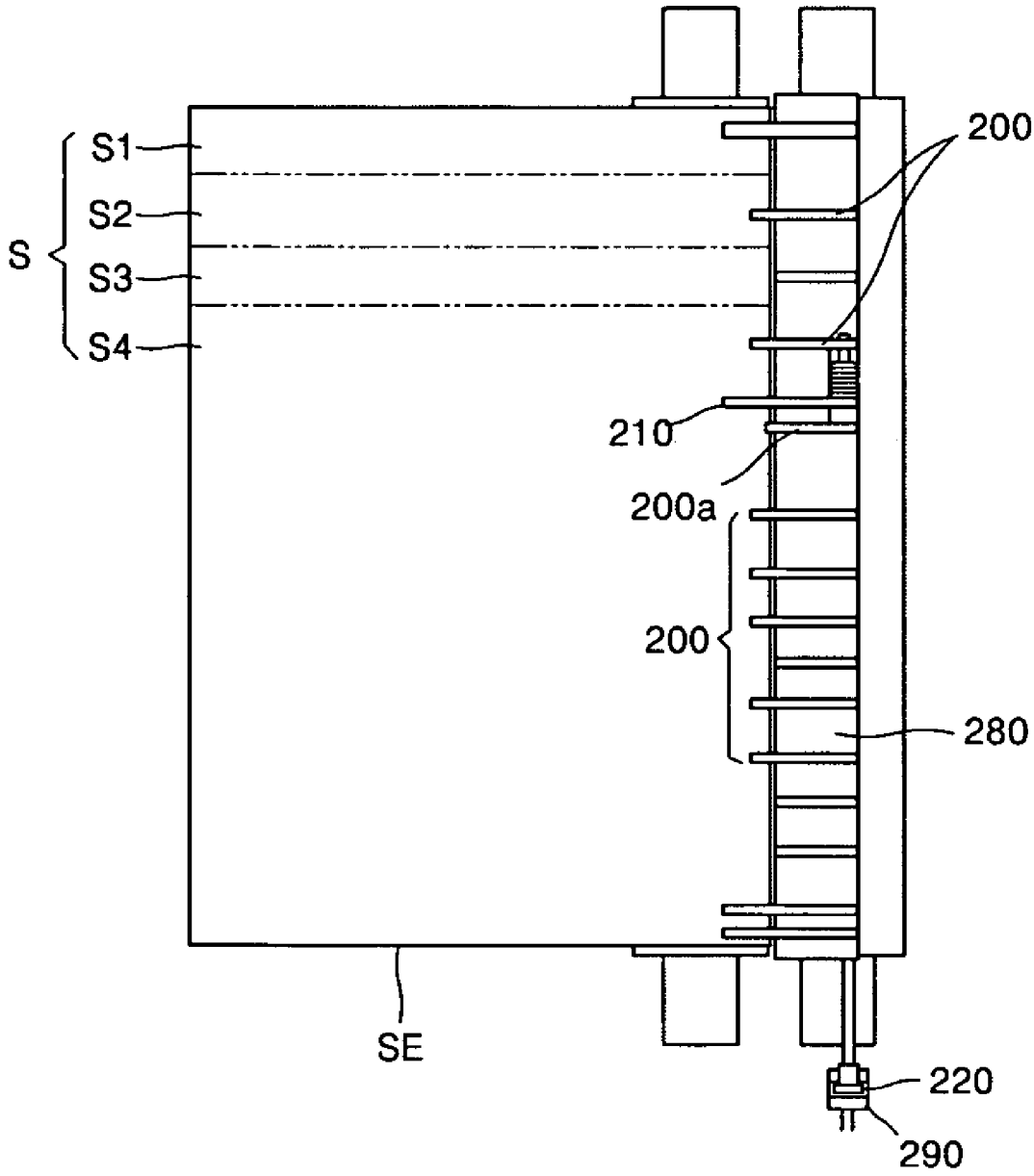
FIG. 5 is a plan view of FIG. 4.

In FIGS. 3, 4 and 5, the fixing member 170, a guide member 200, and a first arm 210 are shown. The guide member 200 guides the sheet of paper S drawn out of the fixing member 170 to the discharge path 310. The guide member 200 has a first guiding portion 201 extending to the discharge path 310 from an outlet of the fixing member 170. The first guiding portion 201 may have a straight line shape or a gently curved shape. In this embodiment of the present general inventive concept, a plurality of guide members 200 are disposed in the width direction of the sheet of paper S as shown in FIGS. 4 and 5. However, the number of the guide members 200 is not limited to the embodiment shown in FIGS. 4 and 5. In this embodiment, a frame 280 extending in the width direction of the sheet of paper S is provided above the second fixing roller 172, and the guiding members 200 are integrally formed with the frame 280.

Figure 6:
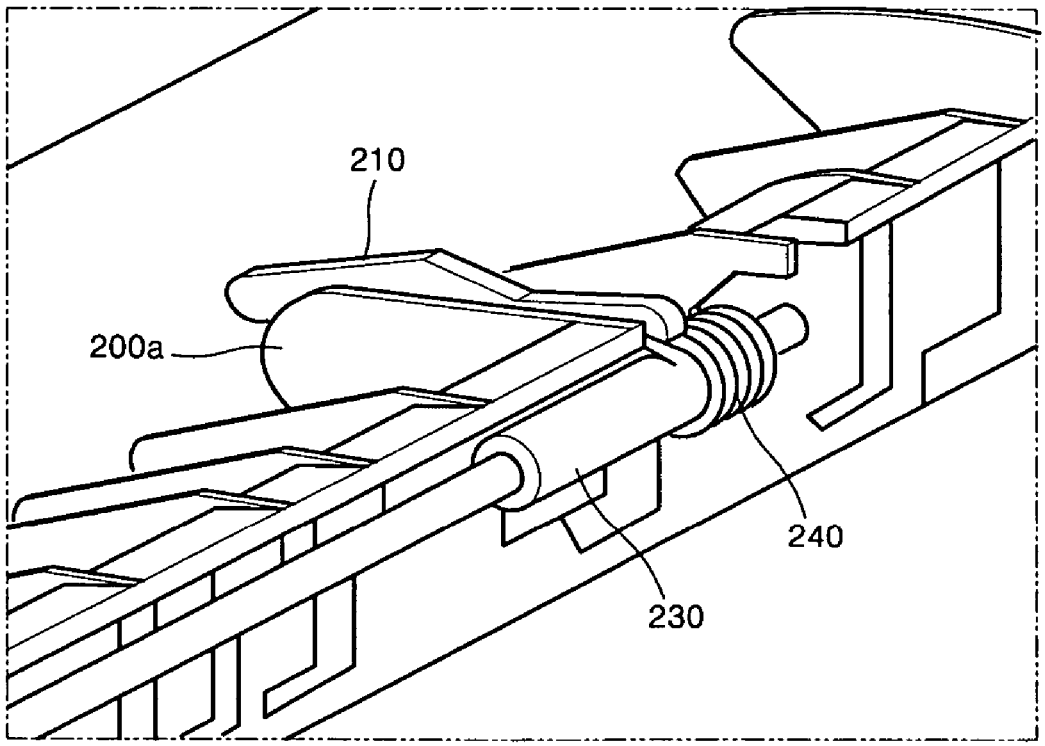
FIG. 6 is a detailed perspective view of a portion E in FIG. 4.

The first arm 210 is rotatably installed on the frame 280. In an embodiment of the present general inventive concept, a rotating member 230 is installed on the frame 280, and the first arm 210 extends from the rotating member 230, as shown in FIG. 6. An end 211 of the first arm 210 extends to the outlet of the fixing member 170. When the sheet of paper S is drawn out of the fixing roller 170, it pushes and rotates the first arm 210. An elastic member 240 is provided on the rotating member 230. The elastic member 240 elastically biases to rotate the first arm 210 such that it contacts the sheet of paper S. According to the configuration described above, the first arm 210 pushes the sheet of paper S toward the discharge path 310.

One of the guide members 200*a* near the first arm 210 has a slightly different shape from the other guide members 200. Referring to FIGS. 4, 5 and 6, the guide member 200*a* has a second guiding portion 202, which is slightly shorter than the first guiding portion 201. Specifically, the front end 204 of the second guiding portion 202 extends toward the discharge path 310 a shorter distance than the front end 203 of the first guiding portion 201. In an aspect of this embodiment the front end 204 of the second guiding portion 202 has a round shape to reduce contact resistance with respect to the sheet of paper S.

As shown in FIG. 4, a second arm 220 may be further provided at the end 231 of the rotating member 230. Reference numeral 290 designates a sensor that turns on/off according to whether the sheet of paper S is discharged from the fixing member170 by the second arm 220 rotating together with the first arm 210. An optical sensor or a micro switch may be used for the sensor 290.

Figure 7:
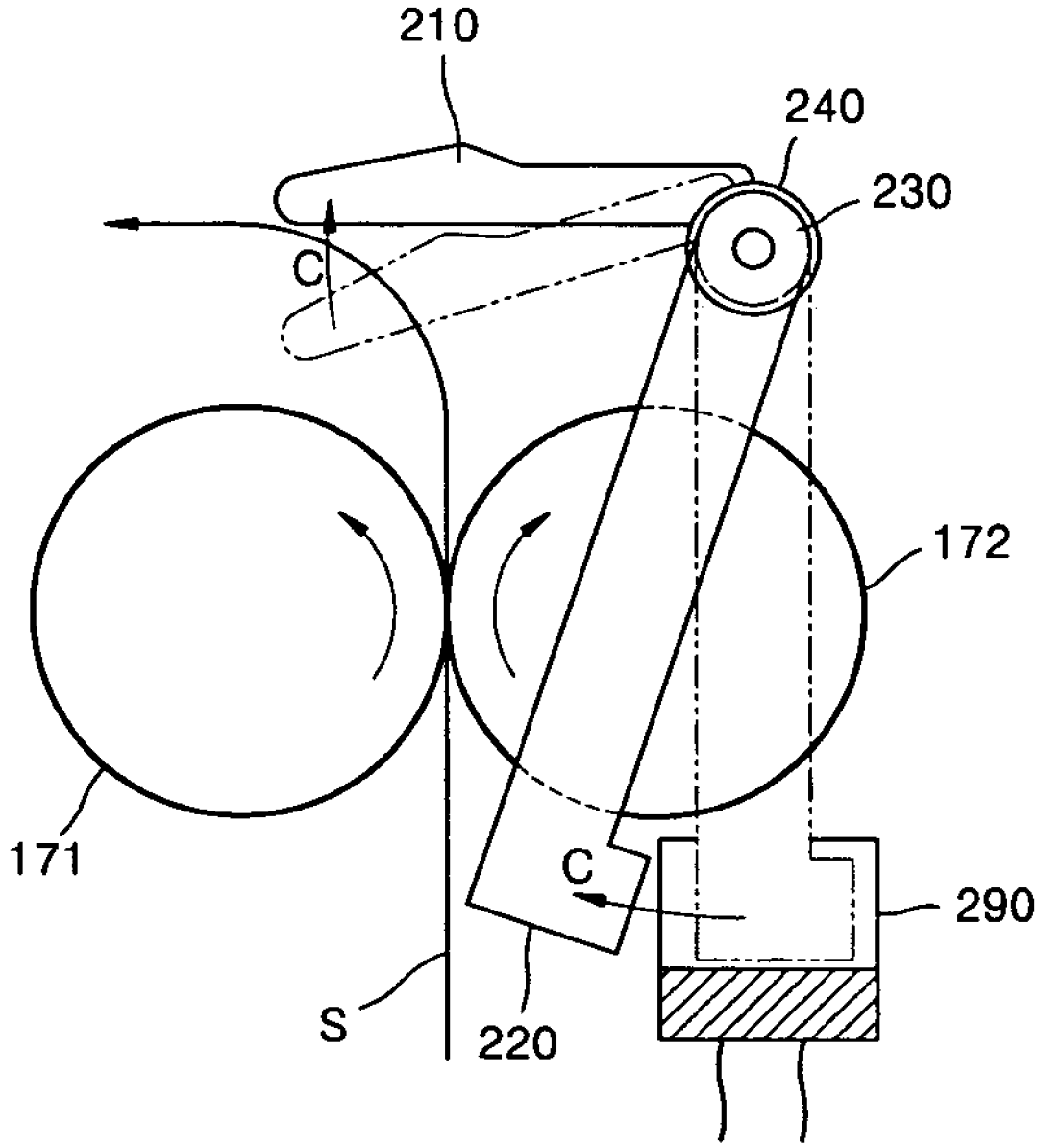
FIG. 7 is a sectional view illustrating a function of a first arm illustrated in FIG. 4.

FIG. 7 is a sectional view illustrating an operation of the first arm 210. Effects of the present general inventive concept will be described with reference to FIGS. 3 through 7.

The sheet of paper S drawn out of the paper cassette 180 by the pickup roller 181 or supplied along the returning path 320 for duplex printing is guided between the transfer belt 150 and the transfer roller 160 by the feed roller 182. The transfer belt 150 has a color toner image as it undergoes charging, exposure, development and transfer processes described above. The color toner image is transferred to the sheet of paper S. The sheet of paper S to which the color toner image has been transferred enters the fixing unit 170 and is discharged after the color toner image is fixed thereto by heat and pressure.

The sheet of paper S discharged from the fixing member 170 is bent and guided to the discharge path 310 while contacting the first guiding portion 201. Since the guide members 200 are fixedly installed, the first guiding portion 201 contacts the back of the sheet of paper S throughout the period in which the sheet of paper is guided to the discharge path 310. In the case of duplex printing or when a sheet of paper whose back side has been already printed, toner fixed to the back of the sheet of paper S is melted by the heat supplied from the fixing member 170. For this reason, the toner can be separated from the sheet of paper and adhered to the first guiding portion 201, as described above. It is more likely that the toner adheres to the front end 203 of the first guiding portion 201. When the toner adheres to the front end 203 of the first guiding portion 201, the front end of the discharged sheet of paper S becomes caught on the first guiding portion 201, thereby causing a paper jam in the discharge path 310.

In order to prevent or reduce such a phenomenon, the friction between the guide members 200 and the sheet of paper S must be reduced as much as possible. For this purpose, the first arm 210 is used. Referring to FIG. 7, the first arm 210 initially blocks the outlet of the fixing member 170. The sheet of paper S discharged from the fixing member 170 pushes against the first arm 210 and turns in a direction of arrow C. Here, the elastic member 240 applies an elastic force so that the first arm 210 is kept in contact with the back of the sheet of paper S. As the elastic force and the pushing force applied to the first arm 210 due to the stiffness of the sheet of paper S are balanced, the sheet of paper S is bent toward the discharge path 310.

Since the first arm 210 rotates smoothly in balance with the pushing force applied by the sheet of paper S and the elastic force of the elastic member 240, the friction between the guide members 200 and the sheet of paper S can be reduced drastically around the first arm 210. Further, since the first arm 210 guides the sheet of paper S to the discharge path 310, the guide member 200*a* near the first arm 210 is not obstructed when guiding the sheet of paper S to the discharge path 310 even when the front end 204 of the guide member 200*a* includes the second guide portion 202 that is shorter than the first guiding portion 201. Therefore, the contact duration between the sheet of paper S and the guide members 200 can be reduced.

Due to the above-described structure, the amount of toner adhering to the first guiding portion 201 can be effectively reduced. Although the above embodiment is described with reference to the image forming apparatus capable of duplex printing and having separate discharge and returning paths, the structure according to the present general inventive concept described above can effectively prevent a paper jam when a with an image already formed thereon sheet of paper is used in an image forming apparatus having no returning path for duplex printing.

The sensor 290, which is turned on or off by the second arm 220 rotating together with the first arm 210, may be used to determine whether or not a paper jam occurs. For example, if there is no sheet of paper S detected by the sensor 290 within a predetermined period of time since the sheet of paper S has been drawn out of the paper cassette 180, it is determined that the sheet of paper S is jammed in the paper feeding path between the paper cassette 180 and the fixing member 170. In addition, if the sensor 290 is turned on for a predetermined period of time after the sheet of paper S has been detected by the sensor 290, it may be determined that a paper jam has occurred in the fixing member 170 or the discharge path 310.

Figure 8:
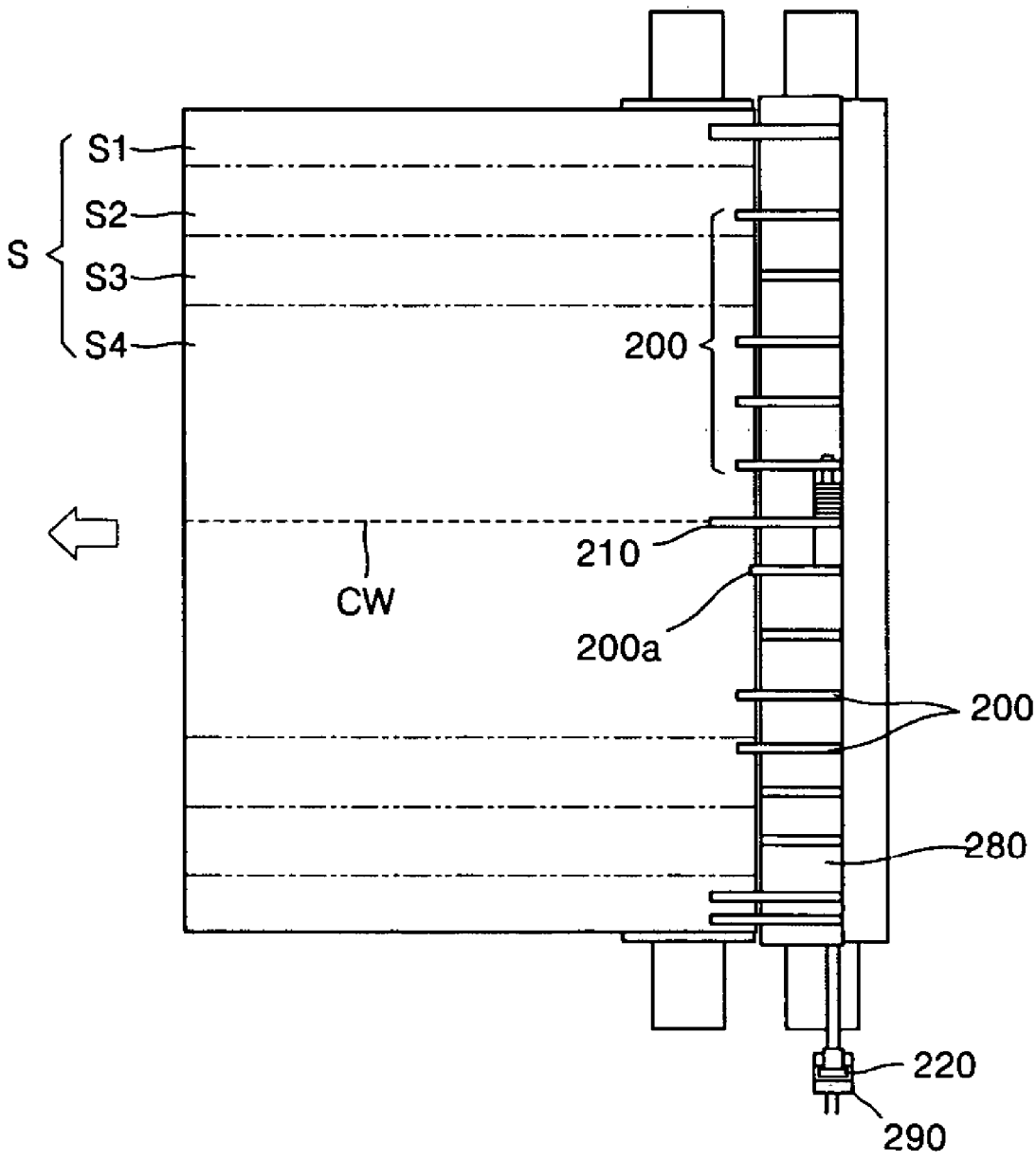
FIG. 8 is a plan view of the image forming apparatus of FIG. 3 illustrating a paper feeding method according to an embodiment of the present general inventive concept.

Since a function of the first arm 210 is to prevent toner from adhering to the first guiding portion 201, it is an aspect that the first arm 210 is positioned to contact an image area of the sheet of paper S. The image area refers to a portion of the sheet of paper S in which an image is actually formed and which excludes the front end and predetermined side margins of the sheet of paper S. The image forming apparatus may use sheets of paper of different sizes S1, S2, S3 and S4 having different widths and lengths. Sheets of paper S1, S2, S3 and S4 may be along one side edge SE as shown in FIG. 5. In this case, it is preferable that the first arm 210 is positioned to contact and guide a sheet of paper S4 having a usable minimum width. As shown in FIG. 8, when a sheet of paper S1, S2, S3 or S4 is moved along a center of the width CW, it is an aspect that the first arm 210 is positioned at the center of the width of the sheet of paper S.

Although the above embodiment has been described with reference to the single first arm 210, the scope of the present general inventive concept is not limited thereto. Alternatively, a plurality of first arms 210 may be installed. In this case, it is preferable that the guide member 200*a* near the first arm 210 has the second guiding portion 202. The fixing member 170, the guide members 200 and 200*a*, the first and second arms 210 and 220, the elastic member 240 and the sensor 290 may be integrated into an inclusive fixing unit.

As described above, a fixing unit and an image forming apparatus having the fixing unit according to the embodiment of the present general inventive concept can effectively prevent a paper jam, which may occur when toner adheres to the guide members or the discharge path of the sheet of paper as the image formed on the back of the sheet of paper melts due to the heat of the fixing roller when performing a double-sided printing or when using a sheet of paper with an image already formed thereon.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fixing unit used with an image forming apparatus that fixes a toner image to a sheet of paper and discharges the sheet of paper to a discharge path, the fixing unit comprising:

a pair of fixing rollers that rotate and face each other and apply heat and pressure to a toner image transferred to the sheet of paper using electrophotography;

a plurality of guide members disposed in the width direction of the sheet of paper to guide the sheet of paper discharged from the pair of fixing rollers to the discharge path, each of the guide members including a first guiding portion extending toward the discharge path from an outlet of the pair of fixing rollers;

a first arm rotatably installed between the guide members to elastically contact the sheet of paper drawn out of the pair of fixing rollers, and guide the sheet of paper to the discharge path; and an elastic member to elastically bias the first arm such that the first arm contacts the sheet of paper, wherein a guide member adjacent to the first arm has a second guide portion that is shorter than the first guide portions.

2. The fixing unit of claim 1, further comprising:

a sensor to detect the sheet of paper drawn out of the pair of fixing rollers; and a second arm to rotate together with the first arm and turn on or off the sensor according to whether the first arm contacts the sheet of paper.

3. The fixing unit of claim 1, wherein the first arm is located within an image area of the sheet of paper.

4. The fixing unit of claim 1, wherein the sheet of paper is moved along a center line of a width thereof and the first arm is positioned at the center of the width of the sheet of paper.

5. The fixing unit of claim 1, wherein the sheet of paper is moved along one side edge thereof and the first arm is positioned such that it can guide a sheet of paper having a usable minimum width.

6. An image forming apparatus comprising:

a printing unit to transfer a toner image to a sheet of paper using electrophotography;

a pair of fixing rollers to rotate and face each other and apply heat and pressure to the toner image;

a discharge path to discharge the sheet of paper to which the toner image has been fixed;

a plurality of guide members disposed in a width direction of the sheet of paper to guide the sheet of paper discharged from the pair of fixing rollers to the discharge path, each of the guide members having a first guiding portion extending toward the discharge path from an outlet of the pair of fixing rollers;

a first arm rotatably installed between the guide members to elastically contact the sheet of paper drawn out of the pair of fixing rollers and to guide the sheet of paper to the discharge path; and an elastic member to elastically bias the first arm such that the first arm contacts the sheet of paper, wherein a guide member adjacent to the first arm has a second guide portion that is shorter than the first guide portion.

7. The image forming apparatus of claim 6, further comprising:

a sensor detecting the sheet of paper drawn out of the pair of rollers; and a second arm rotating together with the first arm to turn on or off the sensor according to whether the first arm contacts the sheet of paper.

8. The image forming apparatus of claim 6, wherein the first arm is located within an image area of the sheet of paper.

9. The image forming apparatus of claim 6, wherein the sheet of paper is moved along a center line of a width thereof and the first arm is positioned at the center of the width of the sheet of paper.

10. The image forming apparatus of claim 6, wherein the sheet of paper is moved along one side edge thereof and the first arm is positioned such that it can guide a sheet of paper having a usable minimum width.

11. An image recording medium guide unit downstream of a fixing member that discharges the image recording medium to a discharge path from the fixing member, the guide unit comprising:

a plurality of first guide members disposed in the width direction of the image recording medium to guide the image recording medium discharged from the fixing member to the discharge path, each of the guide members including a first guiding portion extending toward the discharge path from an outlet of the fixing member;

a second guide member positioned between a pair of first guide members and having a second guide portion that is shorter than the first guide portions; and a first arm elastically installed adjacent to the second guide member to elastically contact the image recording medium drawn out of the fixing member and to guide the image recording medium to the discharge path.

12. The image recording medium guide unit of claim 11, further comprising:

a sensor detecting the image recording medium drawn out of the fixing member; and a second arm rotating together with the first arm and turning on or off the sensor according to whether the first arm contacts the image recording medium.

13. The image recording medium guide unit of claim 11, wherein the first arm is located within an image area of the image recording medium.

14. The image recording medium guide unit of claim 11, wherein the image recording medium is moved along a center line of a width thereof, and the first arm is positioned at the center of the width of the image recording medium.

15. The fixing unit of claim 11, wherein the image recording medium is moved along one side edge thereof, and the first arm is positioned such that it can guide the image recording medium having a usable minimum width.

16. A fixing unit used with an image forming apparatus, the fixing unit comprising:

a fixing member that fixes an image on an image recording medium and discharges the fixed image recording medium to a discharge path;

a plurality of first guide members disposed in the width direction of the image recording medium to guide the image recording medium discharged from the fixing member to the discharge path, each of the guide members including a first guiding portion extending toward the discharge path from an outlet of the fixing member;

a second guide member positioned between a pair of first guide members and having a second guide portion that is shorter than the first guide portions; and a first arm elastically installed adjacent to the second guide member to elastically contact the image recording medium drawn out of the fixing member and to guide the image recording medium to the discharge path.

17. The image recording medium guide unit of claim 16, further comprising:

a sensor detecting the image recording medium drawn out of the fixing member; and a second arm rotating together with the first arm and turning on or off the sensor according to whether the first arm contacts the image recording medium.

18. The image recording medium guide unit of claim 16, wherein the first arm is located within an image area of the image recording medium.

19. The image recording medium guide unit of claim 16, wherein the image recording medium is moved along a center line of a width thereof, and the first arm is positioned at the center of the width of the image recording medium.

20. The fixing unit of claim 16, wherein the image recording medium is moved along one side edge thereof, and the first arm is positioned such that it can guide the image recording medium having a usable minimum width.

21. An image forming apparatus, comprising:

a fixing member that fixes an image on an image recording medium and discharges the fixed image recording medium to a discharge path;

a plurality of first guide members disposed in the width direction of the image recording medium to guide the image recording medium discharged from the fixing member to the discharge path, each of the guide members including a first guiding portion extending toward the discharge path from an outlet of the fixing member;

a second guide member positioned between a pair of first guide members and having a second guide portion that is shorter than the first guide portions; and a first arm elastically installed adjacent to the second guide member to elastically contact the image recording medium drawn out of the fixing member and to guide the image recording medium to the discharge path.

22. The image recording medium guide unit of claim 21, further comprising:

a sensor detecting the image recording medium drawn out of the fixing member; and a second arm rotating together with the first arm and turning on or off the sensor according to whether the first arm contacts the image recording medium.

23. The image recording medium guide unit of claim 21, wherein the first arm is located within an image area of the image recording medium.

24. The image recording medium guide unit of claim 21, wherein the image recording medium is moved along a center line of a width thereof, and the first arm is positioned at the center of the width of the image recording medium.

25. The fixing unit of claim 21, wherein the image recording medium is moved along one side edge thereof, and the first arm is positioned such that it can guide the image recording medium having a usable minimum width.

26. A fixing unit assembly usable with an image forming apparatus to fix a toner image to a sheet of paper, the fixing unit assembly comprising:

one or more fixing members to press and heat the toner image on the sheet of paper and having an outlet formed therebetween; and a guide unit disposed adjacent to the outlet, including:

a plurality of guide members having a curved guiding surface to change a direction of the sheet of paper received from the outlet of the fixing members toward a discharge path of the image forming apparatus, and at least one rotatable arm disposed between the guide members extending toward the outlet of the fixing members and being elastically biased toward the outlet, and the sheet of paper applies a force to the rotatable arm such that the sheet of paper is guided to the curved guiding surfaces of the guide members by the rotatable arm.

27. The fixing unit assembly of claim 26, wherein the rotatable arm minimizes contact between the sheet of paper and the curved guiding surfaces of the guiding members.

28. The fixing unit assembly of claim 26, wherein the rotatable arm is connected to a sensing arm via a rotatable shaft to rotate therewith such that the sensing arm indicates whether a paper jam has occurred.

29. A guide unit usable with a fixing unit to change a direction of a sheet of paper being transferred from an outlet of the fixing unit to a discharge path of an image forming apparatus, the guide unit comprising:

a plurality of guide members having a curved surface to change a direction of the sheet of paper received from the outlet of the fixing unit toward the discharge path; and at least one rotatable arm disposed between the guide members extending toward the outlet of the fixing unit and being elastically biased toward the outlet of the fixing unit, and the sheet of paper applies a force to the rotatable arm such that the sheet of paper is guided to the curved surfaces of the guide members by the rotatable arm.

30. A guide unit usable with a fixing unit to change a direction of a sheet of paper being transferred from an outlet of the fixing unit to a discharge path of an image forming apparatus, the guide unit comprising:

a plurality of guide members having a curved surface to change a direction of the sheet of paper received from the outlet of the fixing unit toward the discharge path, the plurality of guide members including a first one or more guiding members having a first shape and a second one or more guide members having a second shape that is different from the first shape.

* * * * *